US008631538B2

(12) United States Patent
Huffman

(10) Patent No.: US 8,631,538 B2
(45) Date of Patent: Jan. 21, 2014

(54) DRY VACUUM CLEANER WITH SPOT CLEANING

(75) Inventor: Eric C. Huffman, Lowell, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 248 days.

(21) Appl. No.: 12/968,599

(22) Filed: Dec. 15, 2010

(65) Prior Publication Data

US 2011/0146720 A1 Jun. 23, 2011

Related U.S. Application Data

(60) Provisional application No. 61/287,840, filed on Dec. 18, 2009.

(51) Int. Cl.
*A47L 7/00* (2006.01)

(52) U.S. Cl.
USPC ..... 15/320; 15/324; 15/353

(58) Field of Classification Search
USPC ..... 15/320–322, 353, 324
IPC ..... A47L 7/00
See application file for complete search history.

(56) References Cited

U.S. PATENT DOCUMENTS

| | | | | |
|---|---|---|---|---|
| 1,463,583 | A | 7/1923 | Hollerman | |
| 3,055,031 | A | 9/1962 | Rachlin | |
| 4,019,662 | A | 4/1977 | Dana | |
| 4,137,590 | A | 2/1979 | Brown | |
| 4,240,569 | A | 12/1980 | Bessinger | |
| 4,245,371 | A | 1/1981 | Satterfield | |
| 4,447,930 | A | 5/1984 | Glenn, III et al. | |
| 4,457,042 | A | 7/1984 | Jones et al. | |
| 4,492,001 | A | 1/1985 | Hedrenius | |
| 4,512,057 | A | 4/1985 | Laing et al. | |
| 5,101,532 | A | 4/1992 | Dyson et al. | |
| 6,031,969 | A * | 2/2000 | Burr et al. | 392/404 |
| 6,792,645 | B2 | 9/2004 | Ruff | |
| 6,993,807 | B2 | 2/2006 | Courtney | |
| 7,004,182 | B2 | 2/2006 | Duval et al. | |
| 7,111,356 | B2 | 9/2006 | Courtney et al. | |
| 7,152,273 | B2 | 12/2006 | Courtney | |
| 7,367,076 | B2 | 5/2008 | Makarov et al. | |
| 7,383,605 | B2 | 6/2008 | Anderson et al. | |
| 8,214,968 | B2 * | 7/2012 | Griffith et al. | 15/415.1 |

(Continued)

FOREIGN PATENT DOCUMENTS

| | | |
|---|---|---|
| DE | 9210673 | 11/1992 |
| EP | 0157923 A1 | 10/1985 |

(Continued)

*Primary Examiner* — David Redding
(74) *Attorney, Agent, or Firm* — McGarry Bair PC

(57) ABSTRACT

A vacuum cleaner has a cleaning powder distribution system and an actuator connected to the powder distribution system for selectively dispensing powder from the powder distribution system to soiled spots on a floor surface. In addition, a cleaning fluid distribution system is adapted to selectively distribute a liquid cleaning solution to the soiled spot. A propellant, in the form of an aerosol or compressed gas can be used to distribute the cleaning powder to the floor. A method of cleaning a spot on a surface comprises applying a selected volume of fluid cleaning solution to a selected area on the surface to be cleaned, applying a selected amount of cleaning powder to the selected area and extracting the applied cleaning solution and cleaning powder from the selected area on the surface to be cleaned.

7 Claims, 9 Drawing Sheets

(56) References Cited

U.S. PATENT DOCUMENTS

| | | | | |
|---|---|---|---|---|
| 2004/0141797 | A1* | 7/2004 | Garabedian et al. | 401/279 |
| 2006/0090290 | A1* | 5/2006 | Lau | 15/344 |
| 2006/0096056 | A1* | 5/2006 | Anderson et al. | 15/320 |
| 2006/0191097 | A1* | 8/2006 | Baumhakel | 15/320 |
| 2006/0260088 | A1* | 11/2006 | Nam et al. | 15/320 |
| 2006/0288516 | A1* | 12/2006 | Sawalski | 15/320 |
| 2007/0214595 | A1* | 9/2007 | Grove | 15/320 |
| 2007/0267049 | A1* | 11/2007 | Righetto | 134/34 |
| 2009/0165822 | A1 | 7/2009 | Kintz et al. | |
| 2009/0183335 | A1 | 7/2009 | Griffith et al. | |
| 2011/0056044 | A1* | 3/2011 | Reed, Jr. | 15/320 |
| 2012/0204377 | A1* | 8/2012 | White et al. | 15/322 |

FOREIGN PATENT DOCUMENTS

| | | | |
|---|---|---|---|
| EP | 0182230 | A1 | 5/1986 |
| GB | 2163640 | A | 3/1986 |
| WO | 2008004956 | A1 | 1/2008 |

* cited by examiner

DRY VACUUM CLEANER WITH SPOT CLEANING

CROSS-REFERENCE TO RELATED APPLICATION

This application claims the benefit of U.S. Provisional Patent Application No. 61/287,840, filed Dec. 18, 2009, which is incorporated herein by reference in its entirety.

BACKGROUND OF THE INVENTION

1. Field of the Invention

The invention relates to surface cleaning. In one aspect, the invention relates to a vacuum cleaner having a system for removing soiled spots from carpets with chemicals. In another of its aspects, the invention relates to a dry vacuum cleaner with a system for delivering a powdered cleaning solution to a surface to be cleaned for cleaning soiled spots on a carpet and removing the powdered cleaning solution along with the soil from the carpet surface. In another aspect, the invention relates to a vacuum cleaner for delivering a liquid cleaning solution and a powdered cleaning solution in succession and removing the cleaning solutions from the surface to be cleaned. In another of its aspects, the invention relates to a method for cleaning a surface that has soiled areas with vacuum, cleaning powder and a cleaning liquid.

2. Description of the Related Arts

Floor coverings such as carpets and rugs are prone to marks and stains. Floor coverings can be cleaned in a number of ways, which can be classified as 'wet' or 'dry' cleaning methods. Wet cleaning methods such as washing or shampooing the floor covering have the disadvantage that they leave behind significant residual moisture in the surface to be cleaned, which renders the surface unusable until sufficiently dry. Wet cleaning methods may also cause shrinkage of the floor covering. Dry cleaning generally involves depositing a powdered composition onto the floor covering which can readily absorb soil and contaminants from the floor covering. The powder is worked into the floor covering with the aid of a brush. Finally, the dirty powder can then be removed from the floor covering by a vacuum cleaner. While such compositions are called 'dry', in that they flow as a powder at room temperature, they usually contain a quantity of liquid such as water or organic solvents.

Dry vacuums are known devices for cleaning carpets and other fabric surfaces, such as rugs and upholstery. Some dry carpet vacuums comprise a powder delivery system and a recovery system. The powder delivery system typically includes one or more powder supply containers for storing a supply of cleaning powder and a powder distributor for applying the cleaning power to the surface to be cleaned. The recovery system typically comprises a recovery tank, a nozzle adjacent the surface to be cleaned and in fluid communication with the recovery tank through a working air conduit, and a suction source. The suction source is typically in fluid communication with the working air conduit to draw the soiled cleaning powder from the surface to be cleaned through the nozzle and the working air conduit to the recovery tank.

U.S. Pat. No. 4,245,371 to Satterfield discloses a carpet cleaning machine that can dispense a damp cleaning compound from a powder chamber using a reticulated foam cylinder. A lever is provided for controlling the operation of the foam cylinder. When the powder is being deposited on the surface, a vent is open to the atmosphere so that the vacuum fan will not suck up the powder before the brushes accomplish their cleaning function. When it is desired to vacuum the surface, the lever is moved to the down position to deactivate the powder foam cylinder, which closes the vent allowing the vacuum fan to suck the dispensed powder and accumulated soil into the collection bag of the vacuum chamber.

U.S. Pat. No. 4,447,930 to Glenn et al. discloses a vacuum cleaner having a powder dispenser for storing and selectively dispensing a powder. The dispenser includes a retaining chamber having a dispensing roll and agitating rod for breaking up clumps of powder and facilitating dispensing of the powder through slots. A sliding door can be moved by a lever to block the slots by means of a user actuated slide switch in the control handle. The vacuum can be selectively operated through a push button in a clean mode in which suction is turned off while the powder is dispensed and worked into the carpet by the brush.

U.S. Pat. No. 6,993,807 to Courtney discloses a vacuum cleaner having a dispenser for dispensing dry cleaning material onto a floor surface. The dispenser mounts to an upper face of the cleaner head. The dispenser is connected with a foot pedal that a user can press to rotate the dispenser from an inoperable, upright position to an operable position in which the dispenser is flush with the cleaner head. The dispenser comprises a hopper housing having a plate. The plate has an arm that is movably mounted to a cam that is driven by the main motor of the cleaner. Movement of the plate causes a wire carried by the plate near the dispensing aperture to vibrate to separate powder clumps prior to dispensing. The vibration of the plate also causes the powder to move downwards towards the dispensing aperture.

SUMMARY OF THE INVENTION

According to an embodiment of the invention, a vacuum cleaner comprises a housing having a suction nozzle and that is adapted to move along a surface to be cleaned, a cleaning powder distribution system associated with the housing and having a powder storage container that stores a powdered cleaning solution, a propellant that pressurizes the powdered cleaning solution, a distributor positioned at a location on the housing forwardly of the suction nozzle, a conduit between the powder storage container and the distributor, and a valve in the conduit to control the flow of the powdered cleaning solution from the powder storage container to the distributor, wherein the distributor is configured on the housing to propel the powdered cleaning solution to a target area on the surface to be cleaned adjacent to the housing when the valve is opened, a recovery system adapted to remove soiled powdered cleaning solution from the surface and including the suction nozzle, a recovery tank, a suction source having a suction inlet fluidly connected to the recovery tank and the suction nozzle to draw soiled powdered cleaning solution through the suction nozzle and deposit the soiled cleaning solution in the recovery tank and an actuator coupled to the valve for selectively opening the valve to dispense the powdered cleaning solution from the distributor. Wherein the cleaning powder distribution system is adapted to propel powdered cleaning solution to the selected target area adjacent the housing on the surface to be cleaned when the actuator opens the valve and the propellent comprises pressurized air that is exhausted from the suction source.

In one embodiment, the vacuum cleaner further comprises a liquid cleaning fluid distribution system associated with the housing and adapted to distribute a liquid cleaning solution to the target cleaning area of the surface to be cleaned and the recovery system is configured to remove soiled liquid cleaning solution from the surface to be cleaned.

In one embodiment, the recovery tank includes a cyclonic air/dirt separator assembly and a dirt cup assembly.

In another embodiment, an agitator is mounted to the housing for agitating the surface to be cleaned. In a preferred embodiment, the agitator is a brush.

In another embodiment, a target-illuminating device is mounted to the housing to illuminate a target cleaning area on a surface forwardly of the housing. The target-illuminating device can be a laser light, a light emitting diode (LED) or an incandescent lamp.

DESCRIPTION OF THE PREFERRED EMBODIMENT

Figure 1:
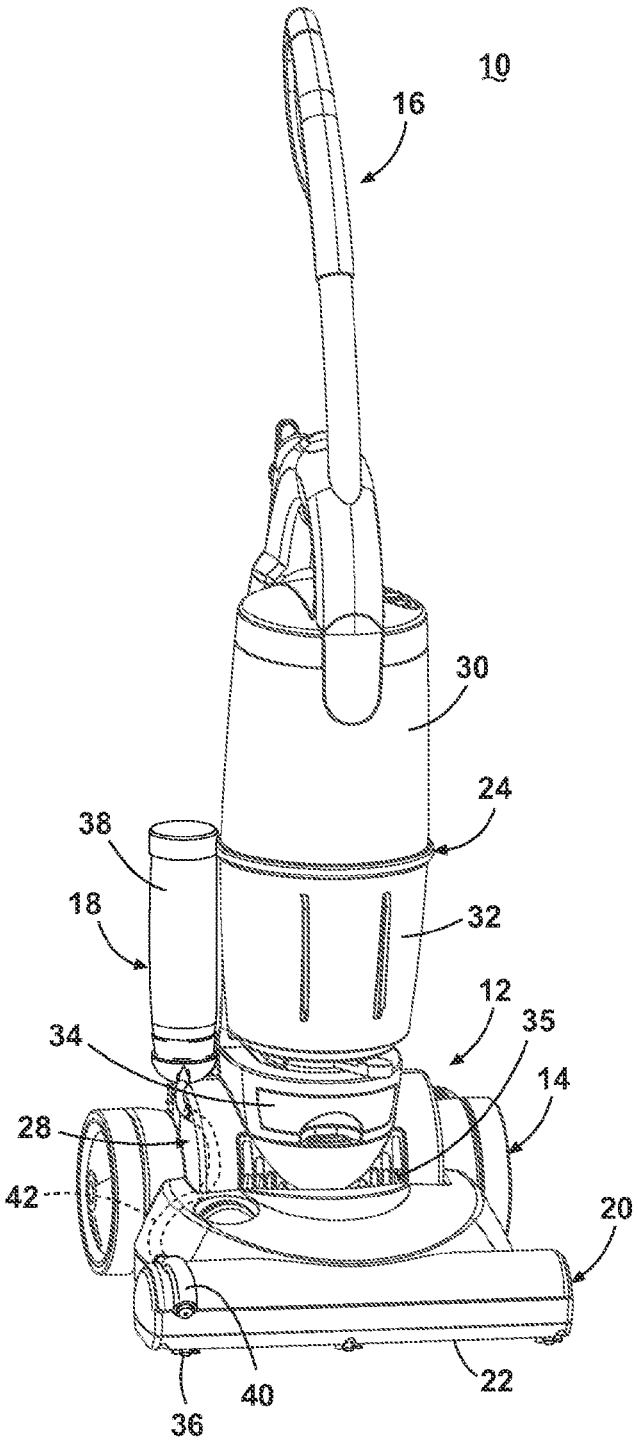
FIG. 1 is a front perspective view of an upright vacuum cleaner with a cleaning powder distribution system mounted thereon for delivering a powdered cleaning solution to a forward area of the vacuum cleaner according to a first embodiment of the invention.

Referring to the drawings, and particularly to FIG. 1, a vacuum cleaner 10 according to the invention is illustrated as an upright vacuum. The vacuum cleaner 10 comprises a housing 12 having a foot assembly 14 for movement across a surface to be cleaned and an upright portion or handle assembly 16 pivotally mounted to the rear of the foot assembly 14 for directing the foot assembly 14 across the surface to be cleaned. The upright vacuum cleaner 10 includes a powder distribution system 18 for storing a powdered cleaning solution and delivering the powdered cleaning solution to the surface to be cleaned and a recovery system 20 for removing the spent powdered cleaning solution and dirt. The powdered cleaning solution may comprise one or several components including an absorbent component such as cornstarch, an oxygen bleach component, and a detergent component. Further, the powdered cleaning solution may be dry or may contain various amounts of moisture.

The recovery system 20 includes a floor suction nozzle 22, a recovery tank assembly 24, a working air conduit 26 (FIG. 2) between the suction nozzle 22 and the recovery tank assembly 24, and a suction source 28. The suction nozzle 22 is adapted to move along a surface to be cleaned. The recovery tank assembly 24 includes a cyclonic air/dirt separator assembly 30 to remove dirt from air and a dirt cup assembly 32 to collect dirt and debris that are separated from air in the air/dirt separator assembly 30. The dirt cup assembly 32 is removably mounted to the handle assembly 16. The housing 12 further includes a working air conduit 26 between the suction nozzle 22 and the air/dirt separator assembly 30. The dirt cup assembly 32 is in communication with the air/dirt separator assembly 28 for receiving debris removed from air in the air/dirt separator assembly 28. A pre-motor filter chamber 34 is in communication with the air/dirt separator assembly 28.

A suction source 28 is located in the foot assembly 14. The suction source 28, typically a motor and fan assembly (not shown), is fluidly connected to the suction nozzle 22, the working air conduit 26, the air/dirt separator assembly 30 and the dirt cup assembly 32 for moving dirt-laden air from the suction nozzle 22 through the working air conduit 26 and through the air/dirt separator assembly 30. The vacuum cleaner 10 shares features and operation of a well-known upright vacuum cleaner, which will not be described in detail herein except as necessary for a complete understanding of the invention. In a known manner, entrained dirt particles are separated from the working airflow inside the air/dirt separator assembly 30 and are introduced in a known manner into the dirt cup assembly 32 where they are accumulated until disposed of. The cyclonic dirt separator and dirt cup assembly 12 can comprise an assembly such as disclosed in U.S. Pat. No. 7,651,544, which is incorporated herein in its entirety. The working airflow exits the air/dirt separator assembly 30 and flows through the optional pre-motor filter chamber 34 before entering the suction source 28 whereupon it is exhausted to atmosphere in a known manner through the downstream exhaust filter chamber 35. The vacuum cleaner 10 also includes an agitation system 36 mounted to the housing 12 for agitating the surface to be cleaned. As an example, the agitator in the agitation system 36 may be a conventional motor-driven brush assembly for agitating the surface to be cleaned.

Figure 2:
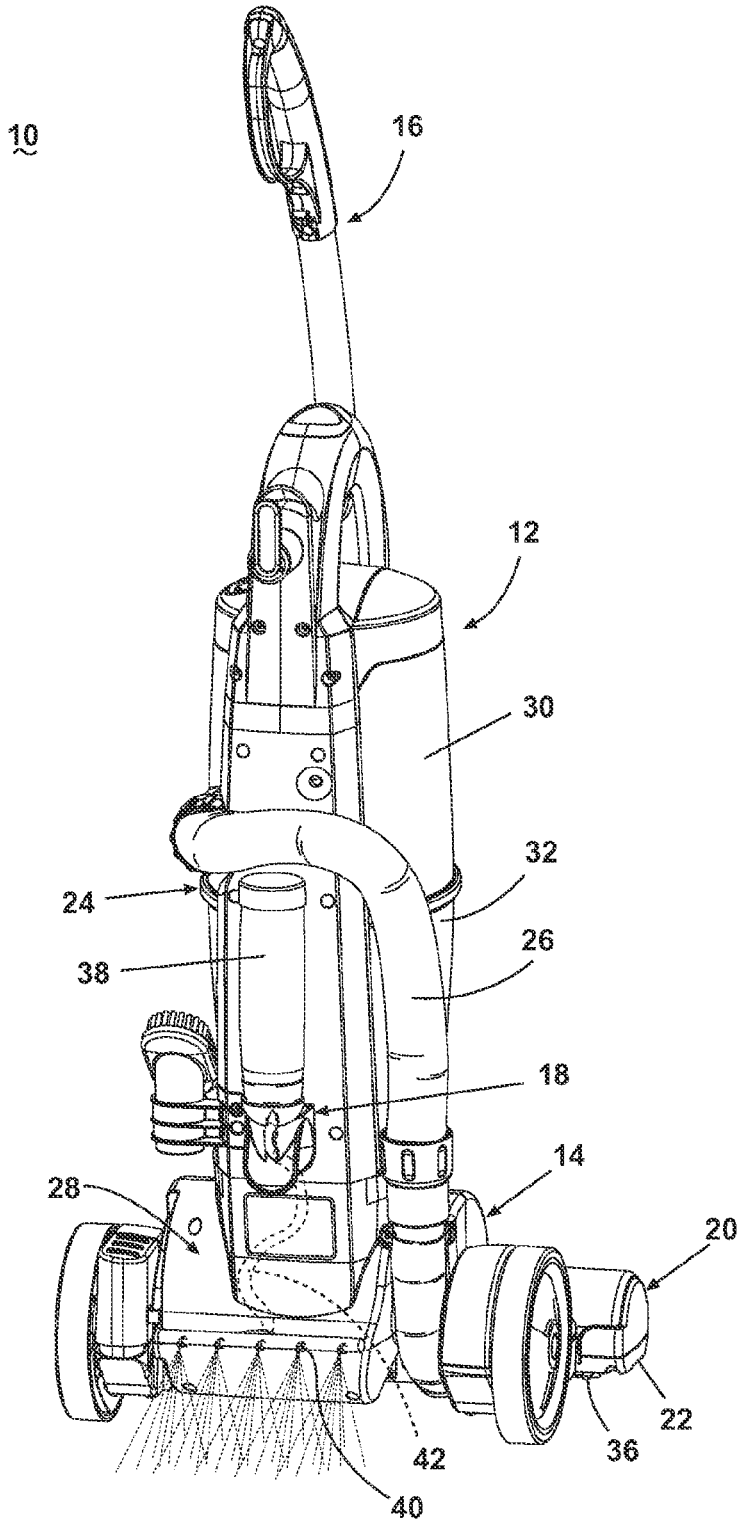
FIG. 2 is a rear perspective view of an upright vacuum cleaner illustrating a second embodiment the invention, with a cleaning powder distribution system mounted thereon for delivering a powdered cleaning solution to a rearward area of the vacuum according to the invention.

FIGS. 1 and 2 generally illustrate the components of a powder distribution system 18 including a powder storage container 38, a powder distributor 40 for depositing the powdered cleaning solution onto a surface to be cleaned, and a conduit 42 between the powder storage container 38 and the powder distributor 40. FIGS. 1 and 2 also illustrate the components of the powder distribution system 18 supported by the housing 12 at alternate locations. In FIG. 1, the foot assembly 14 is illustrated as supporting the powder distributor 40 at a forward portion thereof and the powder storage container 38 is supported at a rearward portion thereof. The powder storage container 38 is fluidly connected to a powder distributor 40 through the conduit 42. In FIG. 2, the handle assembly 16 is illustrated as supporting the powder distributor 40 at a rearward portion thereof and the powder storage container 38 is illustrated as being supported at a rearward portion of the housing 12 above the foot assembly 14.

Figure 3:
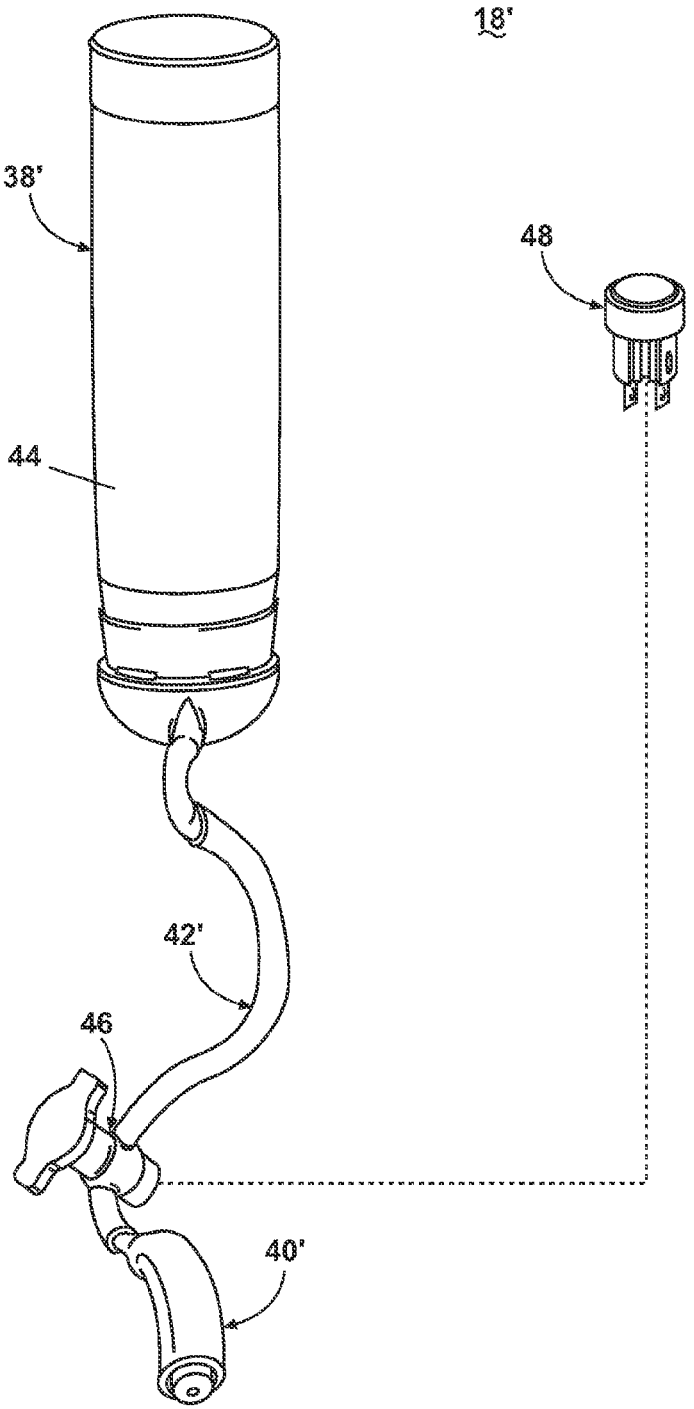
FIG. 3 is a schematic view showing a portion of a powder distribution system of the vacuum cleaner of either FIG. 1 or 2 wherein the powder is dispensed using an aerosol delivery system.

FIGS. 3-6 illustrate alternative embodiments of the powder distribution system 18. For example, FIG. 3 schematically illustrates that the powder distribution system 18' can use an aerosol means for delivering the powdered cleaning solution to the surface to be cleaned. Therefore, like parts will be identified with like numerals bearing a prime (') symbol, with it being understood that the description of the like parts of the first embodiment applies to the second embodiment, unless otherwise noted. The powder distribution system 18' is illustrated as a compressed air powder distribution system, which may be associated with the housing 12 and is adapted to distribute a powdered cleaning solution to a surface to be cleaned. The powder distribution system 18' includes a powder storage container 38' in the form of a can 44, a valve assembly 46 for regulating the dispensing of the powdered cleaning solution, an actuator 48 operably coupled to the valve assembly 46 for selectively dispensing the powdered cleaning solution through a powder distributor 40' in the form of a nozzle onto the surface to be cleaned, and a conduit 42' that fluidly couples the powder storage container 38 to the valve assembly 46 and powder distributor 40'. The can 44 stores a supply of powdered cleaning solution as well as a quantity of compressed propellant gas to provide propellant force necessary to dispense the powdered cleaning solution from the powder distributor 40'. The actuator 48 is illustrated as a pushbutton that may be selectively depressed and released by a user; the button may be located on the handle assembly 16' for easy manipulation by a thumb of the user.

The valve assembly 46 and actuator 48 can take a variety of forms. For example, the valve assembly 46 can include a housing having an inlet and an outlet, a valve member movable relative to a valve seat to control the flow of powder and propellant between the inlet and the outlet. The actuator 48 may be operably coupled to the valve member to control operation of the valve member through any conventional manner using electrical and mechanical means. For example, when the actuator 48 is in a first position, the valve member outlet is closed and powder and propellant can not be dispensed therethrough. When the actuator is in a second position, the valve member is moved to an open position so that powder and propellant can pass therethrough to the powder distributor 40'. Alternatively, the valve member and actuator 48 can be part of an electrical circuit that includes a switch that controls the flow of current through the electrical circuit for selectively actuating the valve member when the actuator is depressed by a user.

The valve assembly 46 is configured to selectively fluidly couple the can 44 with the powder distributor 40'. The powdered cleaning solution is delivered to the surface to be cleaned via the actuator 48, which is operably coupled with the valve assembly 46. When the actuator 48 is actuated by a user, the valve assembly 46 is opened to fluidly couple the can 44 to the powder distributor 40'. The propellant gas that is injected during the filling process of the can 44 generates positive pressure inside the can 44. When the valve assembly 46 is opened by the actuator 48 the energy stored in the pressurized gas is efficiently used to eject a plume of the powdered cleaning solution from the powder distributor 40'.

Such a powder distribution system 18' is consumable and can be replaced by a user after consumption. As an alternative to a propellant gas, compressed air can be used as a propellant. In that case, a compressed air cartridge (not shown) fluidly coupled to a powder storage container 38' can replace the can 44 and the compressed air cartridge can be used to propel the powdered cleaning solution onto the surface to be cleaned.

Figure 4A:
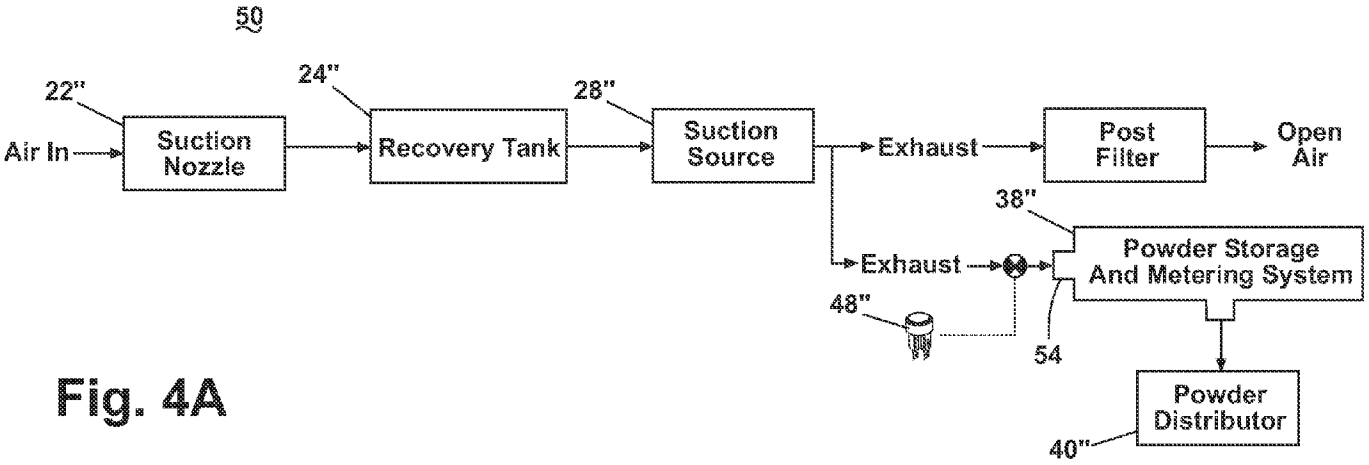
FIGS. 4*a* and 4*b* are schematic views showing alternative powder distribution systems for the vacuum cleaner of either FIGS. 1-2 wherein the powder is dispensed by air ported from the exhaust of a suction source of the vacuum.
Figure 4B:
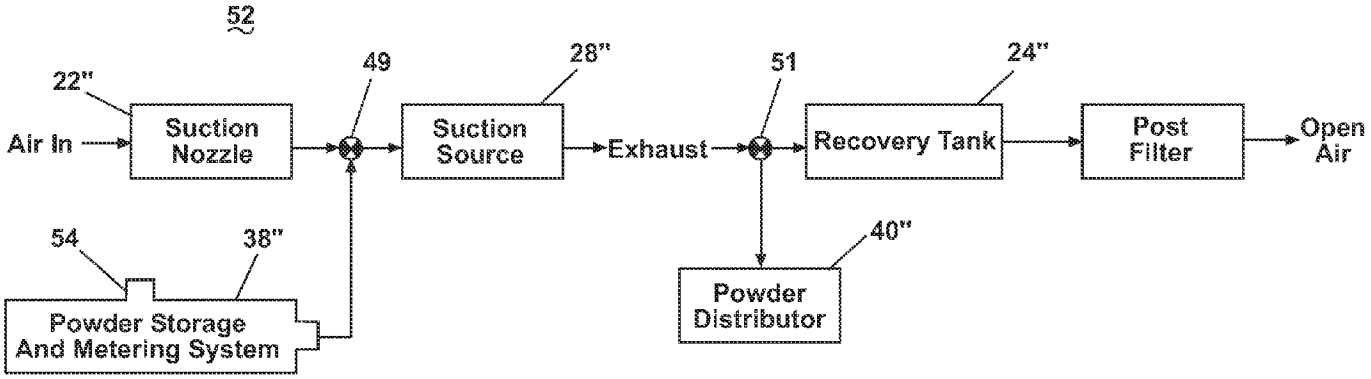

As an alternative to propellant gas and compressed air, from the vacuum cleaner suction source 28 can be used to propel powdered cleaning solution onto the surface to be cleaned. Exhaust air can be ported downstream of the suction source 28 from the vacuum motor/fan exhaust air stream, illustrated in FIG. 4*a* as a first pathway 50. The numerals in FIGS. 4*a* and 4*b* are identified with like numerals bearing a double prime (") symbol, with it being understood that the description of the like parts of the first embodiment applies to the second embodiment, unless otherwise noted. In FIG. 4*a*, a powder storage container 38" has an inlet slot or inlet opening 54 that is selectively opened with actuator bottom 48" to pass working air into the powder storage container and metering system 38". The working air then exits the powder storage container 38" while entraining the powdered cleaning solution and carries the powdered cleaning solution through the powder distributor 40".

The actuator 48" is connected to the powder distribution system 18" for selectively dispensing the powdered cleaning solution. For example, the inlet opening 54 can be opened via the actuator 48". Thus, when the actuator 48" is pressed, the exhaust from the suction source 28" is fluidly coupled to the powder distribution system 18" and powdered cleaning solution is dispensed. When the actuator 48" is pressed, the ported air is used to eject a stream of compressed air and entrained powdered cleaning solution onto the surface to be cleaned. In the case of pathway 50, exhaust air can be ported downstream of the suction source 28" into the powder storage container 38".

FIG. 4*b* illustrates a similar embodiment that is used with a dirty air system in which the powder storage container and metering system is connected to the working air conduit between the suction nozzle 22" and the suction source 28" through a venturi valve 49 which, when opened, draws powder from the powder storage container and metering system 38" into the working air conduit and through the suction source 28". The exhaust from the suction source 28" is then ported through a 3-way valve 51 to divert the powder containing exhaust to the powder distributor 40". Typically, this system is used when the suction nozzle 22" is not picking up waste material. When the powder is not being distributed to the spot on the floor, the suction nozzle will pick up the dirt and powder on the floor surface, the venturi valve 49 will be closed and the valve 51 will direct the exhaust gas from the suction source to the recovery tank and then to a post filter.

The system of FIGS. 4*a* and 4*b* schematically illustrates portions of the powder distribution system 18". However, the embodiments of FIGS. 4*a* and 4*b* can also include any necessary tubing and valves needed for distributing the powdered cleaning solution onto the surface to be cleaned. Further, while the inlet opening 54 has been described as a single orifice it is contemplated that multiple orifices can be used.

Figure 5:
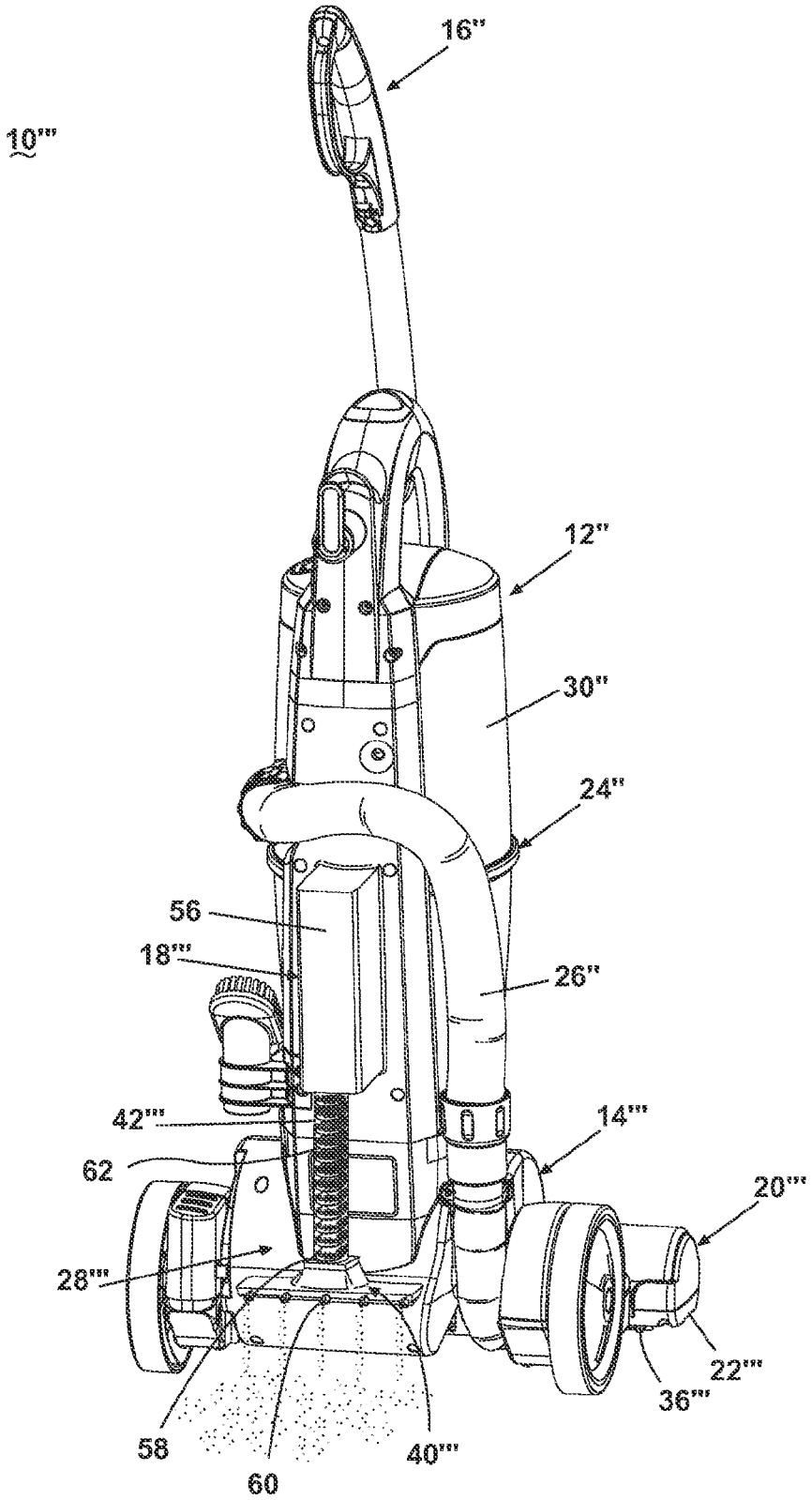
FIG. 5 is a rear perspective view of an upright vacuum cleaner illustrating a third embodiment of the invention wherein a supply of cleaning powder is dispensed by an auger.

FIG. 5 illustrates another alternative powder distribution system 18''' wherein the powder distribution system 18''' reduces pellets stored in a supply hopper 56 to a powdered form prior to distribution. Like parts will be identified with like numerals bearing a triple prime (''') symbol. A supply hopper 56 is in fluid communication with a powder distributor 40''' that has an inlet 58 and a dispenser 60, via a conduit 42'''. An auger 62 is located in the conduit 42''' and is in communication with the supply hopper 56, for causing pelletized cleaning solid to be withdrawn from the supply hopper 56 and to be transported to the powder distributor 40'''. A motor (not shown) is provided for rotating the auger 62. In order to vary the flow of pellets and subsequently the flow of powder to the powder distributor 40''', the speed of the auger 62 can be varied. The auger 62 is configured to reduce the pellets to a powder before reaching the powder distributor 40'''. Alternatively, the auger 62 can be configured to transport whole pellets from the supply hopper 56 to the powder distributor 40'''. The pellets can remain uncrushed and can be applied to the cleaning surface intact to enhance agitation and cleaning performance. The powdered or pelletized cleaning solution can then be dispensed through dispenser 60 in the powder distributor 40'''. The dispenser 60 is illustrated in FIG. 5 as a plurality of holes. A separate auger or brush (not shown) can be disposed horizontally within the powder distributor 40''' to ensure uniform distribution through the dispenser 60 in the powder distributor 40'''. The separate auger or brush can also be driven by a motor (not shown). The separate auger or brush can be rotated, thereby causing powder to be transported longitudinally to each of the holes in the powder distributor 40'''. Such a separate auger or brush would also help to reduce agglomeration of the powder cleaning solution.

Alternatively, the pellets can be of a size and consistency that they need not be broken up by the auger 62. The agitation system 36 can be used to work the pellets into the carpet when the pellets are used whole. Further, the pellets can be distributed using the aerosol or ported air as described above.

Figure 6:
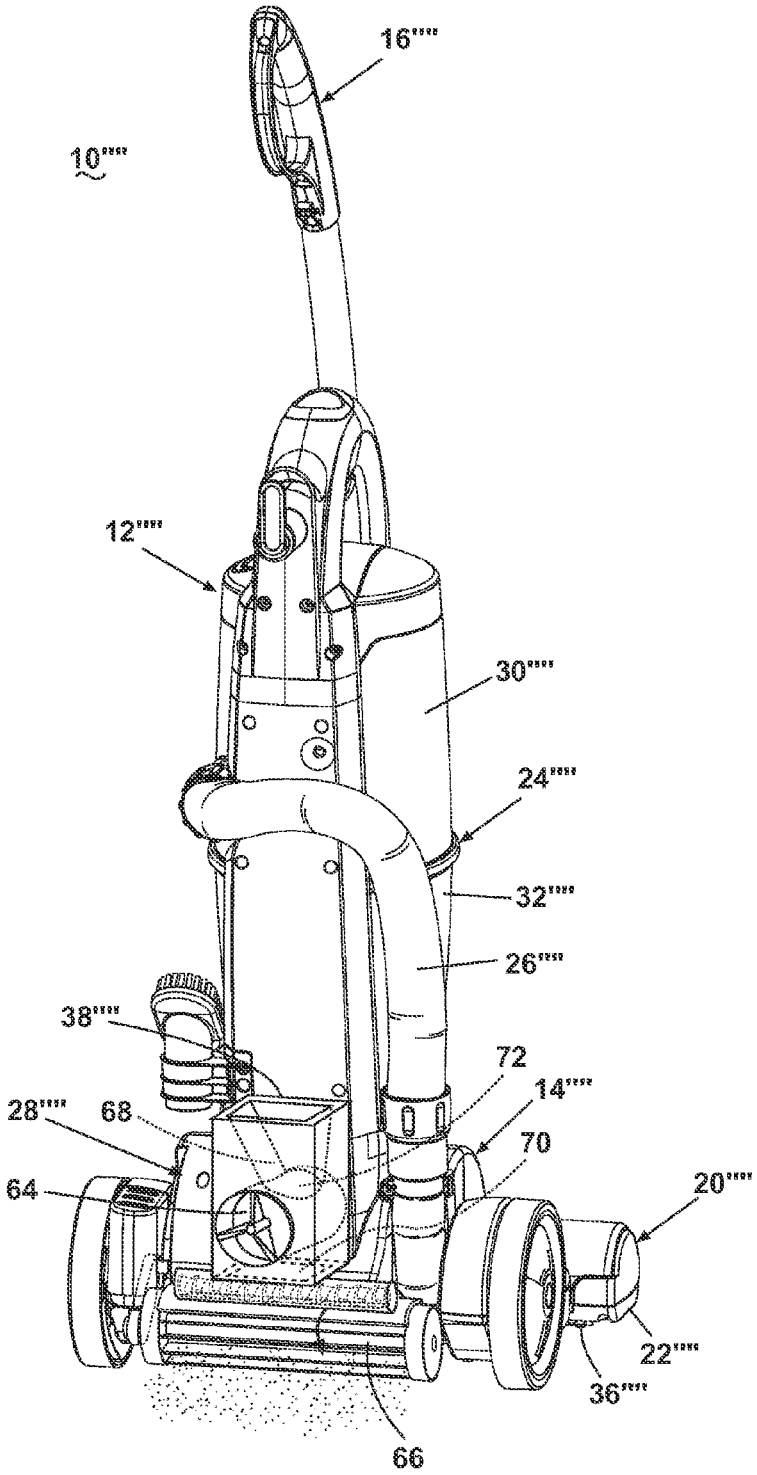
FIG. 6 is a rear perspective view of an upright vacuum cleaner illustrating a fourth embodiment of the invention wherein the powder is dispensed using a metering drum and spreader.

FIG. 6 is a schematic view illustrating yet another alternative powder distribution system 18'''' wherein the powder cleaning solution is dispensed using a metering device 64 and a spreader 66. Like parts will be identified with like numerals bearing a quadruple prime (''''') symbol. A powder storage container 38'''' has a supply area 68 and an outlet 70. The metering device 64 is rotatably mounted within the powder storage container and is located at the powder storage container 38'''' outlet 70 and is in communication with a powder distributor 40'''' in the form of a spreader 66 or brush. A cavity 72 extends along the length of the metering device 64. When the metering device 64 is rotated within the cavity 72, the powder cleaning solution moves from the supply area 68 to the outlet 70 where the powder cleaning solution drops under gravity into a spreader 66, which is illustrated as a brush. From there the spreader 66 rotates and powder cleaning solution falls onto the surface to be cleaned and the spreader 66 disperses the powder cleaning solution and agitates into the surface. A closure member (not shown), which can be selectively opened by a lever (not shown), can be located at the outlet 70 to prevent discharging of the powder cleaning solution from the metering device 64 to the spreader 66.

Figure 7:
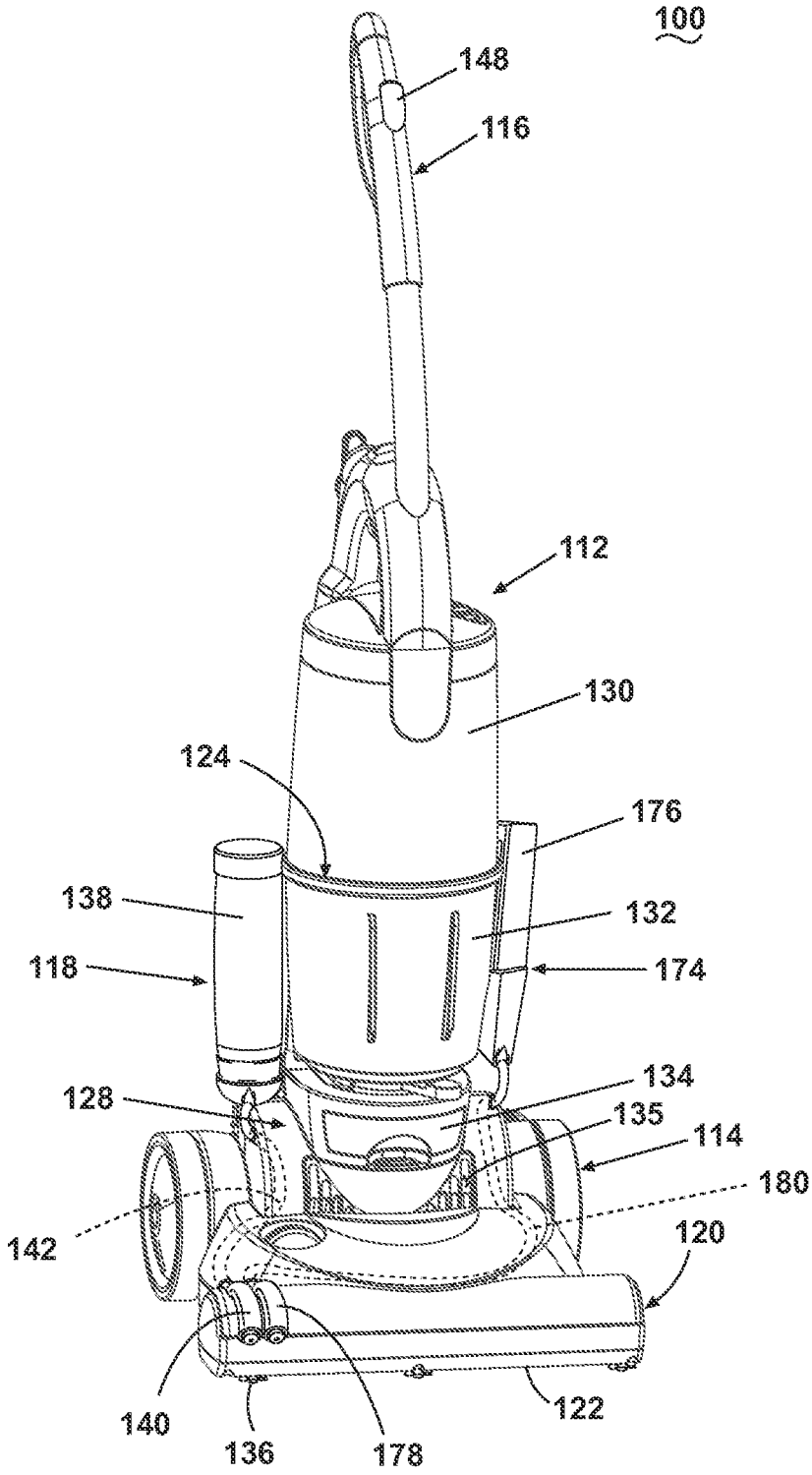
FIG. 7 is a front perspective view of an upright vacuum cleaner illustrating a fifth embodiment of the invention 2, with both a cleaning fluid distribution system and a cleaning powder distribution system mounted thereon.

FIG. 7 is a perspective view of a vacuum cleaner 100 with both a cleaning powder distribution system 118 and a cleaning fluid distribution system 174 mounted thereon for selectively delivering a selected volume of cleaning fluid and a selected volume of the cleaning powder to a location adjacent to the vacuum cleaner 100 according to an additional embodiment of the invention. The additional embodiment 100 is similar to the first embodiment 10. Therefore, like parts will be identified with like numerals increased by 100, with it being understood that the description of the like parts of the first embodiment applies to the additional embodiment, unless otherwise noted.

One difference between the first embodiment 10 and the second embodiment 100 is that the vacuum 100 includes the cleaning fluid distribution system 174. The cleaning fluid distribution system 174 includes liquid storage container 176, a liquid distributor 178 for depositing the liquid cleaning solution onto the surface to be cleaned, and a conduit 180 between the liquid storage container 176 and the liquid distributor 178. Like the powder distribution system 118, the liquid distribution system 174 can be consumable and would need to be replaced by a user after consumption. Preferably, the liquid storage container 176 is an aerosol container with a conventional release valve for dispensing liquid cleaner, such as Woolite® OxyDeep PowerShot™ sold by BISSELL Homecare, Inc. of Grand Rapids, Mich. Alternatively, the liquid storage container 176 can be a refillable container that has an outlet connected to a pump for dispensing a liquid cleaning composition under pressure and controlled by a valve as is common in extraction cleaners such as disclosed in U.S. Pat. No. 6,131,237 which is incorporated herein by reference. Like the powder distribution system 118, the liquid distribution system 174 can be supported by the housing 112 at alternate locations. A single actuator 148 can control the distribution of the both the liquid cleaning solution and the powdered cleaning solution. The actuator 148 is illustrated as being a push button located on the handle assembly 116 for easy manipulation by a thumb of the user. The powder distribution system can include a conventional solenoid valve (not shown) electrically connected in a circuit with the actuator 148 or to a controller for selective dispensing of the power. Likewise, the cleaning fluid distribution system 174 can also be controlled by a solenoid valve that is connected in an electrical circuit to the actuator or to a controller for selective distribution of the cleaning fluid.

The actuator 148 is operatively coupled to the cleaning powder distribution system 118 and cleaning fluid distribution system 174 via suitable electrical or mechanical means (not shown). For example, a controller 181 can be located in the vacuum cleaner 100 and can be coupled operably to the cleaning powder distribution system 118, cleaning fluid distribution system 174, and actuator 148 to selectively operate first the cleaning fluid distribution system 174 and then the cleaning powder distribution system 118 when a user actuates the actuator button 148. The controller 181 can be programmed to respond to a signal from the actuator button 148 to initiate a complete spot cleaning cycle in which the liquid cleaning solution and cleaning powder are dispensed in predetermined amounts and at pre-determined timing intervals.

In operation, the vacuum cleaner 100 is prepared for use by the user replacing the consumable elements of the cleaning powder distribution system 118 and the cleaning fluid distribution system 174 as needed. This can include replacing the entire storage containers 138, 176 or merely filling the storage containers 138, 176 with powdered cleaning solution and liquid cleaning solution, respectively. The vacuum cleaner 100 is plugged into a power supply whereupon the suction source 128 becomes energized and generates a vacuum force within the recovery system 120.

Figure 8:
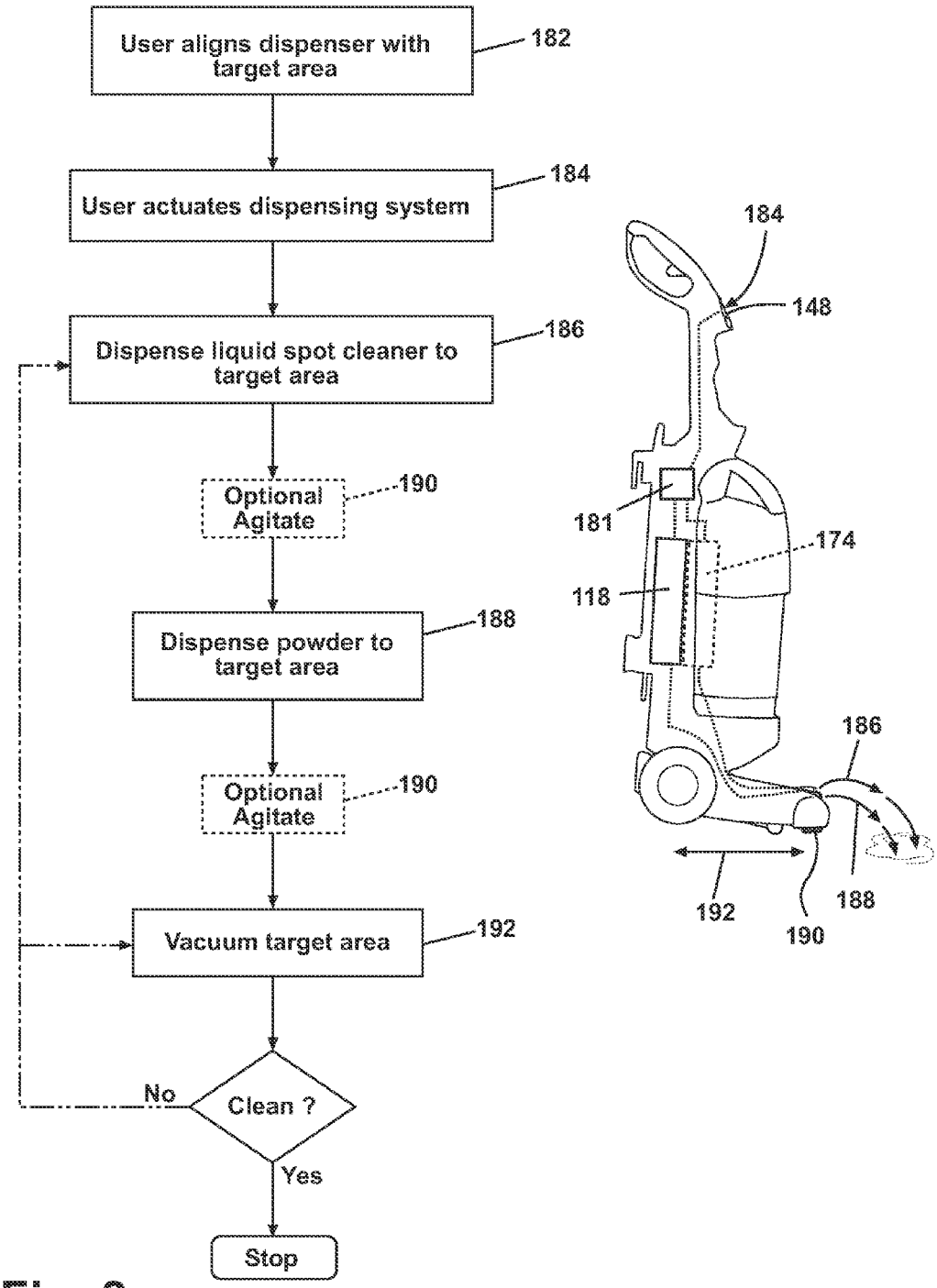
FIG. 8 is a schematic diagram illustrating a method of cleaning a surface according to another embodiment of the invention.

FIG. 8 schematically illustrates the operation of the vacuum cleaner 100. In a first step 182, the user locates the vacuum 100 on the surface to be cleaned and aligns the cleaning powder distribution system 118 and the cleaning fluid distribution system 174 with the location or target area on the surface to be cleaned. A user then pushes the actuator button 148, in a second step 184, to start the two-step cleaning solution process. After actuation, the controller 181 selectively delivers, in a third step 186, a selected volume of the liquid cleaning solution to the target location via the cleaning fluid distribution system 174. Then the controller 181 selectively delivers, in a fourth step 188, a selected amount of the powdered cleaning solution to the target location via the cleaning powder distribution system 118. Thus, the controller 181 applies the liquid cleaning solution to the target location and applies the cleaning powder to the location where the selected volume of the liquid cleaning solution was dispensed.

The agitation system can be simultaneously energized, in an optional agitation step 190, to agitate the liquid cleaning solution and powdered cleaning solution into the surface to be cleaned. Alternatively, this agitation step 190 may be split to agitate the surface after the liquid cleaning solution is dispensed, in the third step 186, and then the surface is agitated after the liquid cleaning solution and cleaning powder are dispensed after the fourth step 188.

During normal cleaning mode, the vacuum force draws a working airflow in through the suction nozzle, which is positioned adjacent the location on the surface to be cleaned. In a final vacuum step 192, suction can be applied to the location to extract the applied cleaning solutions from surface as well as dirt and debris. In the final step 192, the working airflow containing the cleaning solutions and dirt and debris flows through the recovery system 120, whereupon the cleaning solution and debris are separated from the air and are collected in the dirt cup assembly 132. Dry working air passes through the pre-motor filter chamber 134 and into the suction source 128 whereupon it is exhausted through the exhaust filter chamber 135 to atmosphere through vents in the base assembly 16. When such dirt and debris have been removed and the location is clean the process is stopped. If the location is not clean, any portion of the process can be repeated.

When extensively soiled areas are encountered, it may be desirable to selectively interrupt the suction to the surface for a selected time to increase dwell time of the cleaning solutions on the location. After the selected time, suction can be restored to the surface to remove soiled cleaning solution and debris from the location.

This increase in the dwell time of the solutions on the stain location can enhance cleaning effectiveness. This increased dwell time can be accomplished in a variety of ways. For example, the user can remove the vacuum cleaner 100 from the location or the user can de-energize the suction source 128 of the vacuum cleaner 100. Alternatively, it is contemplated that the vacuum cleaner 100 can be configured to reduce suction at the suction nozzle 128 to a avoid extracting the cleaning solution during a predetermined dwell time. During this dwell time, the vacuum cleaner 100 can agitate the surface with the cleaning solutions located thereon.

Alternatively, the user can initiate the two-step process with an actuator and the powdered cleaning solution and liquid cleaning solution can be selectively delivered to the surface to be cleaned based on the movement of the vacuum cleaner 100 as it is moved forward and backward across the surface to be cleaned. That is, the vacuum cleaner 100 can be configured to dispense the liquid cleaning solution from the liquid storage container 176 when the vacuum cleaner 100 is moved forward and to dispense the powdered cleaning solution from the powder storage container 138 when the vacuum cleaner 100 is moved backward.

Figure 9:
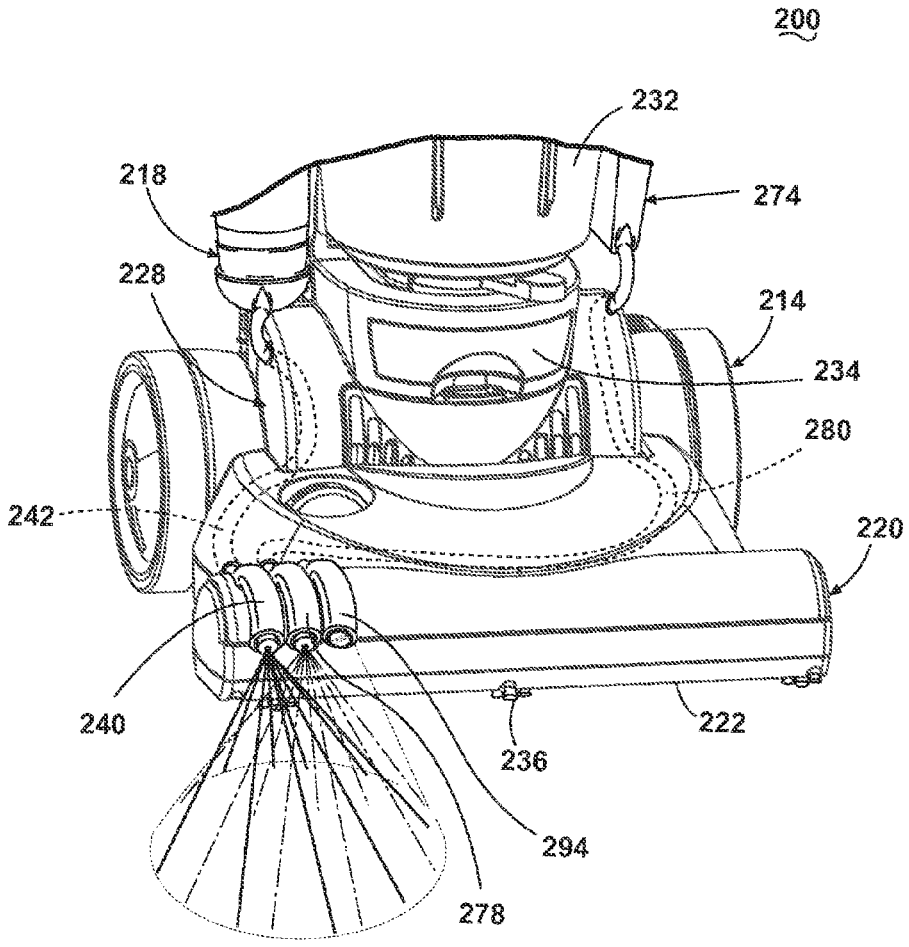
FIG. 9 is a partial front perspective view of a vacuum cleaner illustrating an additional embodiment of invention wherein a target-illuminating device is provided.

FIG. 9 is a partial perspective view of a vacuum cleaner 200 with both a cleaning powder distribution system 218 and a cleaning fluid distribution system 274 mounted thereon as well as a target-illuminating device 294 according to an additional embodiment of the invention. The additional embodiment 200 is similar to the embodiment 100 illustrated in FIG. 7. Therefore, like parts will be identified with like numerals increased by 100, with it being understood that the description of the like parts of the first embodiment applies to the additional embodiment, unless otherwise noted.

One difference between the embodiment of vacuum cleaner 100 and the embodiment of vacuum cleaner 200 is that the vacuum 200 includes the target-illuminating device 294, which illuminates the location adjacent to the vacuum cleaner 200 where the selected cleaning operations are to be performed. The target-illuminating device 294 can be supported by the housing 212 at alternate locations provided that it illuminates the location and indicates the target location for the cleaning solution application. A second actuator (not shown) on the handle assembly 216 can be used to control the target-illuminating device 294. Alternatively, the target-illuminating device 294 can be activated after the actuator button 148 (FIG. 7) is pushed but before the controller 281 selectively delivers a selected volume of the cleaning fluid to a location on the surface to be cleaned. The target-illuminating device 294 can be selected from known illumination sources, including a laser, light emitting diodes (LED), or incandescent lamps, for example. The illumination sources can be configured to produce visible or ultra violet (UV) light to enhance visibility of the surface to be cleaned and more easily identify stains. UV light is particularly useful for identifying organic stains such as blood and urine. Further, the embodiment can also include any electrical leads necessary to connect the target-illuminating device 294 with the controller 181.

While the invention has been specifically described in connection with certain specific embodiments thereof, it is to be understood that this is by way of illustration and not of limitation. For example, although the target-illuminating device has been described in the context of a vacuum having both a cleaning powder distribution system 218 and a cleaning fluid distribution system 274 mounted thereon it is contemplated that such a target-illuminating device 294 can be used on a vacuum having only a cleaning powder distribution system 218. As another example, instead of a target-illuminating device being used to indicate the location, a graphic, such as an arrow, (not shown) could be located on the housing 212 and positioned to indicate the target location for the cleaning solution application. Thus, reasonable variation and modification are possible within the foregoing description and drawings without departing from the spirit of the invention, which is described in the appended claims.

What is claimed is:

1. A vacuum cleaner comprising:

a housing having a suction nozzle and that is adapted to move along a surface to be cleaned;

a cleaning powder distribution system associated with the housing and having a powder storage container that stores a powdered cleaning solution, a propellant that pressurizes the powdered cleaning solution, a distributor positioned at a location on the housing forwardly of the suction nozzle, a conduit between the powder storage container and the distributor, and a valve in the conduit to control the flow of the powdered cleaning solution from the powder storage container to the distributor, wherein the distributor is configured on the housing to propel the powdered cleaning solution to a target area on the surface to be cleaned adjacent to the housing when the valve is opened;

a recovery system adapted to remove soiled powdered cleaning solution from the surface and including the suction nozzle, a recovery tank, a suction source having a suction inlet fluidly connected to the recovery tank and the suction nozzle to draw soiled powdered cleaning solution through the suction nozzle and deposit the soiled cleaning solution in the recovery tank; and an actuator coupled to the valve for selectively opening the valve to dispense the powdered cleaning solution from the distributor; and wherein the cleaning powder distribution system is adapted to propel powdered cleaning solution to the selected target area adjacent the housing on the surface to be cleaned when the actuator opens the valve and the propellant comprises pressurized air that is exhausted from the suction source.

2. The vacuum cleaner of claim 1, further comprising a liquid cleaning fluid distribution system associated with the housing and adapted to distribute a liquid cleaning solution to the target cleaning area of the surface to be cleaned; and the recovery system is configured to remove soiled liquid cleaning solution from the surface to be cleaned.

3. The vacuum cleaner of claim 1, further comprising an agitator mounted to the housing for agitating the surface to be cleaned.

4. The vacuum cleaner of claim 3 wherein the agitator is a brush.

5. The vacuum cleaner of claim 1, further comprising a target-illuminating device mounted to the housing to illuminate the target cleaning area on a surface forwardly of the housing.

6. The vacuum cleaner of claim 5 wherein the target-illuminating device is at least one of a laser light, a light emitting diode (LED), and an incandescent lamp.

7. The vacuum cleaner of claim 1 wherein the recovery tank includes a cyclonic air/dirt separator assembly and a dirt cup assembly.

* * * * *